US012389955B2

(12) United States Patent
Casillas et al.

(10) Patent No.: US 12,389,955 B2
(45) Date of Patent: Aug. 19, 2025

(54) GARMENT ADJUSTING SYSTEM

(71) Applicant: NIKE, Inc., Beaverton, OR (US)

(72) Inventors: Tina M. Casillas, Beaverton, OR (US); Fanny Yung Ho, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 420 days.

(21) Appl. No.: 17/971,264

(22) Filed: Oct. 21, 2022

(65) Prior Publication Data

US 2023/0126308 A1 Apr. 27, 2023

Related U.S. Application Data

(60) Provisional application No. 63/270,838, filed on Oct. 22, 2021.

(51) Int. Cl.
*A41C 3/00* (2006.01)
*A41C 3/04* (2006.01)

(52) U.S. Cl.
CPC ..... *A41C 3/0028* (2013.01); *A41C 3/04* (2013.01)

(58) Field of Classification Search
CPC ..... A41C 3/04
See application file for complete search history.

(56) References Cited

U.S. PATENT DOCUMENTS 9,345,274 B1 * 5/2016 Prill ..... A41D 1/215
11,503,864 B1 * 11/2022 Clarke ..... A41C 3/06
11,871,801 B1 * 1/2024 Ratcliff ..... A44C 15/009
2003/0013689 A1 * 1/2003 Helton ..... A61K 31/38 514/420
2023/0051747 A1 * 2/2023 Morgan ..... A43C 11/002
2023/0126308 A1 * 4/2023 Casillas ..... A41C 3/0028 450/36

FOREIGN PATENT DOCUMENTS

CN 101605473 B 6/2014
DE 20210029 U1 8/2002
FR 1033032 A 7/1953

OTHER PUBLICATIONS

International Search Report and Written Opinion received for PCT Patent Application No. PCT/US2022/047502, mailed on Mar. 7, 2023, 12 pages.

* cited by examiner

*Primary Examiner* — Gloria M Hale
(74) *Attorney, Agent, or Firm* — SHOOK, HARDY & BACON L.L.P.

(57) ABSTRACT

This application describes a garment adjusting system that utilizes straps connected to textile elements. A male coupling component with a hook is secured to a first textile element using a first strap, and a female coupling component with a receiving hole is secured to a second textile element using a second strap. The male and female coupling components can be releasably mated by inserting the hook into the receiving hole. Once mated, a level of support provided by the first and/or second textile elements may be adjusted by adjustably sliding the second strap through the female coupling component to adjust a length of the second strap.

17 Claims, 6 Drawing Sheets

GARMENT ADJUSTING SYSTEM

CROSS REFERENCE TO RELATED APPLICATIONS

This application claims priority to U.S. 63/270,838 (filed Oct. 22, 2021), which is incorporated herein by reference in its entirety.

TECHNICAL FIELD

Aspects herein are directed to a garment adjusting system that utilizes straps to which male and female coupling components are coupled.

BACKGROUND

Traditional garments such as nursing bras may utilize various types of clips or attachment means to couple, for example, an outer layer of the nursing bra to a shoulder strap or areas near the shoulder strap when the wearer is not nursing or pumping. However, these clips or attachment means may be difficult to manipulate often requiring two hands to effectively couple the outer layer to the shoulder strap. Moreover, traditional nursing bras typically lack a way to adjust the level of tension or support of the outer layer, which is important when the nursing bra is worn during, for example, athletic activities.

SUMMARY

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1. A garment adjusting system comprising: a first strap having a first end and an opposite second end, the second end of the first strap secured to a first textile element; a male coupling component fixedly coupled to the first end of the first strap; a second strap having a first end and an opposite second end, the second end of the second strap secured to a second textile element; and a female coupling component slidably coupled to the second strap, the female coupling component adapted to releasably mate with the male coupling component, wherein the female coupling component is slidable along a length of the second strap such that movement of the female coupling component in a first direction increases a level of support provided by the garment adjusting system and movement of the female coupling component in an opposite second direction decreases the level of support provided by the garment adjusting system.

Clause 2. The garment adjusting system according to clause 1, wherein the first textile element and the second textile element form, at least in part, the garment.

Clause 3. The garment adjusting system according to any of clauses 1 through 2, wherein the first end of the first strap is unaffixed from the first textile element and the second textile element.

Clause 4. The garment adjusting system according to any of clauses 1 through 3, wherein the first end of the second strap is unaffixed from the first textile element and the second textile element.

Clause 5. The garment adjusting system according to any of clauses 1 through 4, wherein the male coupling component includes a hook.

Clause 6. The garment adjusting system according to any of clauses 1 through 5, wherein the female coupling component includes a body having a receiving hole at one end, a release tab at an opposing end, and a through hole between the receiving hole and the release tab, and wherein the second strap is slidably threaded through the through hole.

Clause 7. The garment adjusting system according to any of clauses 1 through 6, wherein the garment is a bra.

Clause 8. A support garment having an adjusting system, the support garment comprising: a first strap having a first end and an opposite second end, the second end of the first strap secured to a first shoulder strap; a male coupling component coupled to the first end of the first strap; a second strap having a first end and an opposite second end, the second end of the second strap secured to an upper aspect of the a breast-covering portion; and a female coupling component adjustably coupled to the second strap, the female coupling component adapted to releasably mate with the male coupling component, wherein when tension is applied to the first end of the second strap, a length of the second strap as measured between the second end of the second strap and the female coupling component is adjusted.

Clause 9. The support garment according to clause 8, wherein the support garment is a bra.

Clause 10. The support garment according to clause 9, wherein the first breast-covering portion is an outermost layer of the bra.

Clause 11. The support garment according to any of clauses 9 through 10, wherein the bra further includes an inner layer positioned interior to the first breast-covering portion.

Clause 12. The support garment according to any of clauses 9 through 11, wherein a lower aspect of the first breast-covering portion is secured to a lower margin of the bra.

Clause 13. The support garment according to any of clauses 8 through 12, wherein the male coupling component includes a hook.

Clause 14. The support garment according to any of clauses 8 through 13, wherein the female coupling component includes a body having a receiving hole at one end, a release tab at an opposing end, and a through hole between the receiving hole and the release tab, and wherein the second strap is slidably threaded through the through hole.

Clause 15. The support garment according to any of clauses 8 through 14, wherein the first end of the first strap is unaffixed from the first shoulder strap and the first breast-covering portion.

Clause 16. The support garment according to any of clauses 8 through 15, wherein the first end of the second strap is unaffixed from the first shoulder strap and the first breast-covering portion.

Clause 17. A method of manufacturing a garment adjusting system, the method comprising: securing a second end of a first strap to a first textile element; fixedly coupling a male coupling component to a first end of the first strap; securing a second end of a second strap to a second textile element; and adjustably coupling a female coupling component to a first end of the second strap, the female coupling component adapted to releasably mate with the male coupling component, wherein when tension is applied to the first end of the second strap, a length of the second strap as measured between the second end of the second strap and the female coupling component is adjusted.

Clause 18. The method of manufacturing the garment adjusting system according to clause 17, wherein the first strap and the second strap are formed from a low-stretch material.

Clause 19. The method of manufacturing the garment adjusting system according to any of clauses 17 through 18, wherein the male coupling component includes a hook.

Clause 20. The method of manufacturing the garment adjusting system according to clause 19, wherein the female coupling component includes a receiving hole, and wherein when the male coupling component and the female coupling component are releasably mated, the receiving hole of the female coupling component receives the hook of the male coupling component.

BRIEF DESCRIPTION OF THE DRAWINGS

Examples of aspects herein are described in detail below with reference to the attached drawing figures, wherein.

DETAILED DESCRIPTION

Figure 1:
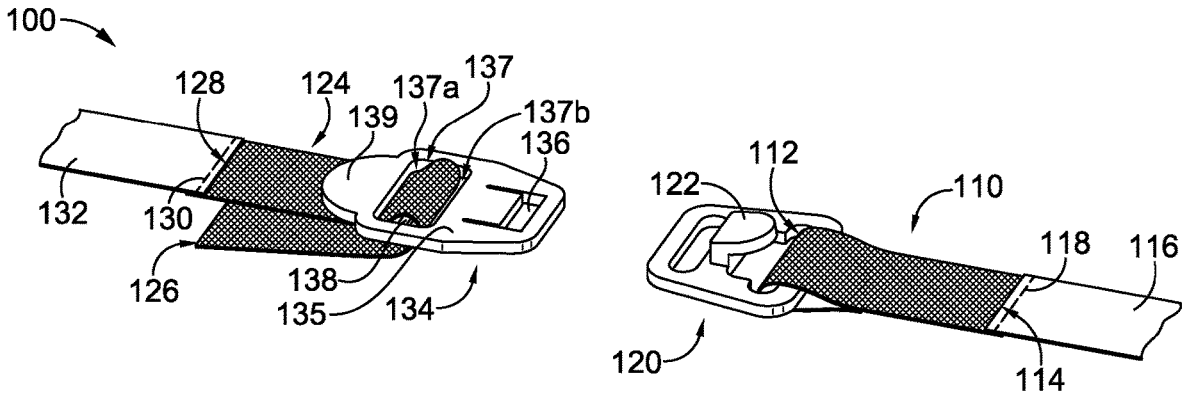
FIG. 1 depicts a side perspective view of a garment adjusting system in an uncoupled state in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Traditional garments such as nursing bras may utilize various types of clips or attachment means to couple, for example, an outer layer of the nursing bra to a shoulder strap when the wearer is not nursing or pumping. However, traditional nursing bras typically lack an ability to adjust the level of tension or support of the outer layer, which is important when the nursing bra is worn during, for example, athletic activities. Moreover, the clips or attachment means associated with the garment may be difficult to manipulate, often requiring the use of two hands.

Aspects herein are directed to a garment adjusting system that includes a first strap with a first end and a second end. The second end of the first strap is secured to a first textile element, and a male coupling component is fixedly coupled to the first end of the first strap. The garment adjusting system further includes a second strap having a first end and a second end. The second end of the second strap is secured to a second textile element, and a female coupling component is slidably coupled to the second strap. In example aspects, the first and second textile elements are part of a single garment or article such as, for example, a bra (including a nursing bra), an upper-body garment, a lower-body garment, an article of footwear, and article of headwear, and the like.

In example aspects, the male coupling component includes a hook, and the female coupling component includes a receiving hole through which the hook of the male coupling component is received. To couple the first and second textile elements, the female coupling component is releasably mated with the male coupling component by positioning the receiving hole of the female coupling component over the hook of the male coupling component. The hook and receiving hole combination is easy to use and enables a wearer to releasably mate the two components using, for example, one hand making the garment adjusting system useable by people with disabilities and/or people whose other hand may be engaged in other activities such as, for example, supporting a baby or a nursing pump.

Once the male and female coupling components are releasably mated, the amount of support provided by the first and/or second textile elements can be increased by pulling on the free first end of the second strap, which decreases the length of the second strap as measured between the second end of the second strap and the female coupling component. This operation may also be carried out using, for example, one hand. The ability to provide an increased level of support when the garment is in the form of, for example, a nursing bra enables the bra to be used for athletic activities eliminating the need for a wearer to change from a nursing bra to an athletic bra when exercising. When the increased level of support is no longer needed, the second strap can be manipulated to increase the length of the second strap as measured between the second end of the second strap and the female coupling component.

Although examples described herein have been in the context of bras, including a nursing bra, aspects herein further contemplate using the garment adjusting system for other types of garments. For example, the garment adjusting system may be used at the waistband of a lower-body garment to quickly couple textile elements together and to quickly adjust the circumferential diameter of the waistband. When incorporated into an article of footwear such as an upper of a shoe, the garment adjusting system may be used to adjust the level of support across, for example, an instep region of the upper. The garment adjusting system may also be used as part of an underband of a bra to join two portions of the underband together and adjust the circumferential tension of the underband. These are just a few examples, and it is contemplated herein that the garment adjusting system may be incorporated into any type of garment for which a quick and easy coupling and adjustment of support is desired.

As used herein, the term "garment" means any article that may be worn by a wearer. Example articles include support garments including bras and nursing bras, upper-body garments such as tops, pullovers, hoodies, jacket/coats, and the like, lower-body garments such as shorts, capris, leggings, pants, and the like, articles of headwear such as hats, caps, sweatbands, and the like, and articles of footwear including athletic shoes. The adjusting system may also be used in equipment such as backpacks, luggage, duffle bags, and the like.

Positional terms may be used when describing the garment with the assumption that the garment is being worn as intended by a wearer standing upright. For example, the term "inner" means a layer or structure that is positioned closer to a body surface of a wearer as compared to other layers or structures of the garment. The term "outer" means a layer or structure that is positioned external to other layers or structures of the garment. In example aspects, an inner layer may be an innermost layer and an outer layer may be an outermost layer of the garment. An upper part of the garment would be located closer to a head area of a wearer compared to a lower part of the garment.

The term "support garment" when used herein refers to an upper-body garment primarily configured to provide support to a wearer's breasts. As such, the support garment may be in the form of a bra, including a nursing bra and/or athletic bra, a tank top, an athletic top, a swimsuit top, and the like. When the garment is in the form of a support garment or bra, the term "breast-covering portion" means the portion of the support garment configured to cover a wearer's breast. As such, the breast-covering portion generally extends from a top part (e.g., near the wearer's clavicle) to a lower part (e.g., the wearer's inframammary fold) of each of the wearer's breasts and from a medial edge (e.g., near the wearer's sternum) to a lateral edge (e.g., near the wearer's axilla) of each of the wearer's breasts. The term "apex region" when referring to the support garment generally means the area where a shoulder strap extends from or is joined to the breast-covering portion or other portions of the support garment. The term "underband" when used in relation to, for instance, a bra refers to the portion of the bra that forms a lower margin of at least the front portion of the bra. The underband is configured to encircle the torso area of a wearer and may include a separate pattern piece or may include an integral extension of the front portion.

The term "strap" generally means an element having a greater length than width with generally parallel longitudinal side edges. The strap may be formed of textile elements (knit, woven, braided, nonwoven, and the like) or non-textile elements. In example aspects, the strap may be formed of a no-stretch or low-stretch material. A no-stretch or low-stretch material generally does not have inherent stretch properties (mechanical or elastic) in response to a tensioning force and thus the length and/or width of the material remains substantially unchanged when subject to the tensioning forces below the material's breaking/tearing point. For example, the strap may undergo a change of length from about 0% of resting length to about 20% of resting length in response to a tensioning force. The no-stretch or low-stretch material may include tightly knit, woven, or braided constructions that do not utilize elastic yarns; non-elastomeric films; knit, woven, nonwoven, or braided constructions that include a surface treatment to limit stretch, and the like.

The term "fixedly coupled" or "fixedly secured" generally means some type of permanent attachment through use of stitching, bonding, adhesives, welding, and the like. The term "slidably coupled" when referring to, for example, the female coupling component and the second strap, means that the female coupling component can be moved (e.g., slid) along a length of the second strap while maintaining the integrity of both the female coupling component and the second strap. The term "releasably mated" when referring to the relationship between the male and female coupling components means that the components can be repeatedly mated (i.e., joined together) and unmated without damaging either of the components.

FIG. 1 depicts a side perspective view of a garment adjusting system 100 in an un-coupled state. The garment adjusting system 100 includes a first strap 110 (indicated with cross-hatching) having a first end 112 and an opposite second end 114. The second end 114 of the first strap 110 is secured to a first textile element 116 by way of, for example, stitching 118 although other permanent affixing technologies are contemplated herein. In example aspects, the first textile element 116 may include a knit construction, a braid construction, a woven construction, a nonwoven construction, and the like.

A male coupling component 120 is fixedly coupled to the first end 112 of the first strap 110. For example, a loop formed at the first end 112 of the first strap 110 may extend around the frame of the male coupling component 120 and be secured to itself using, for example, stitching, adhesives, bonding, and the like. Other ways of fixedly coupling the first end 112 to the male coupling component 120 are contemplated and within the scope herein. The male coupling component 120 may be formed of a number of different materials including plastics, metals, ceramics, composites, and the like.

The male coupling component 120 includes an extension or hook 122 that extends at an angle with respect to a plane defined by the surface of the first strap 110 and/or the first textile element 116. In example aspects, the angle may be less than about 90 degrees, less than about 80 degrees, less than about 70 degrees, less than about 60 degrees, less than about 50 degrees, less than about 40 degrees, less than about 30 degrees, less than about 20 degrees, or from about 5 degrees to about 40 degrees. As used herein, the term "about" means within ±5% of a given value. Having an angle in this range helps to reduce the profile of the hook 122 and make it less likely to catch on other structures.

The garment adjusting system 100 further includes a second strap 124 (shown with cross-hatching) having a first end 126 and an opposite second end 128. The second end 128 of the second strap 124 is secured to a second textile element 132 by way of, for example, stitching 130 although other permanent affixing technologies are contemplated herein. In example aspects, the second textile element 132 may include a knit construction, a braid construction, a woven construction, a nonwoven construction, and the like. In example aspects, the first textile element 116 and the second textile element 132 are part of a single garment as described and depicted herein. The first and second textile elements 116 and 132 may include separate elements or they may represent different portions of the same element.

A female coupling component 134 is removably and slidably coupled to the second strap 124. In some examples, the female coupling component 134 includes a body 135, having a receiving hole 136 at one end and a tab 139 at the opposing end. In addition, the body 135 can include a through hole 137 extending through the body 139. In at least some examples, the through hole 137 can include a bar 138 (e.g., cross bar) that extends across the through hole 137 and divides the through hole 137 into a first slot 137*a* and a second slot 137*b*. In some examples, the first end 126 of the second strap 124 can be threaded through the first slot 137*a*, around the bar 138, and through the second slot 137*b*, such that the second strap 124 and the female coupling component 134 are slidable relative to one another. Although the first end 126 of the second strap 124 is shown positioned below the second textile element 132, aspects herein contemplate that the second strap 124 may be threaded around the bar in the opposite direction such that the first end 126 of the second strap 124 may be positioned above the second textile element 132 with respect to the perspective view shown in FIG. 1.

The female coupling component 134 includes a receiving hole 136 positioned at a distal end of the female coupling component 134. As further described herein, the receiving hole 136 is sized to receive the hook 122 of the male coupling component 120. As depicted in FIG. 1, the female coupling component 134 and the male coupling component 120 are not mated together such that the first textile element 116 is not coupled or secured to the second textile element 132. The female coupling component 134 may be formed of a number of different materials including plastics, metals, ceramics, composites, and the like.

As depicted, the first end 112 of the first strap 110 is not directly affixed to the first textile element 116 and is not directly affixed to the second textile element 132. Similarly, the first end 126 of the second strap 124 is not directly affixed to the second textile element 132 and is not directly affixed to the first textile element 116. In some instances and as described above, the first end 112 of the first strap 110 is looped through the male coupling component 120 and affixed to itself, though it is also contemplated that the first end 112 of the first strap 110 could be looped through the male coupling component 120 and affixed to the first textile element 116.

Figure 2:
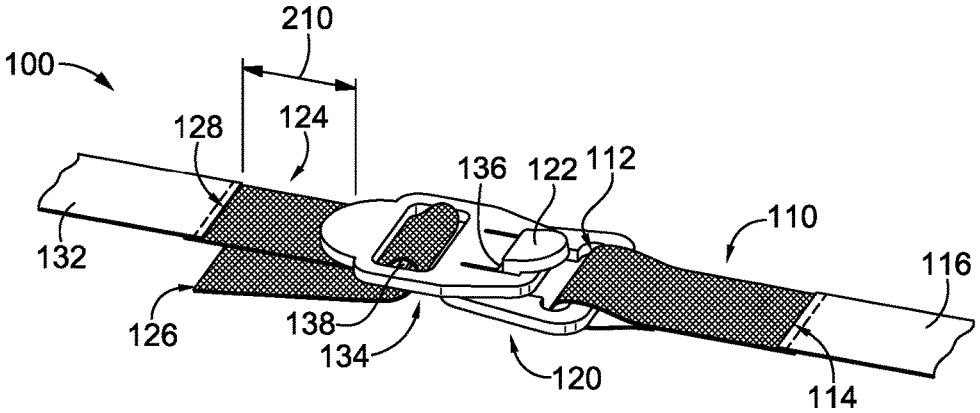
FIG. 2 depicts a side perspective view of the garment adjusting system of FIG. 1 in a coupled state in accordance with aspects herein.

FIG. 2 depicts the garment adjusting system 100 in a coupled state. In the coupled state, the hook 122 of the male coupling component 120 is received into the receiving hole 136 of the female coupling component 134. This is an easy one-handed action for the wearer who simply positions the receiving hole 136 over the hook 122 and then lowers it onto the hook 122. The angular orientation of the hook 122 is great enough that the wearer can easily slide the receiving hole 136 over the hook 122 and small enough that once the hook 122 is received through the receiving hole 136, the male and female coupling components 120 and 134 are maintained in a coupled state.

The garment adjusting system 100 may be used to adjust the level of support provided by the second textile element 132 and/or the first textile element 116. As depicted in FIG. 2, the second strap 124 is positioned such that it has a first length 210 as measured between the second end 128 of the second strap 124 and a proximal end of the female coupling component 134. The term "proximal" when referring to the female coupling component 134 means the portion of the female coupling component that is located closest to the second textile element 132, and the term "distal" when referring to the female coupling component 134 means located farther away from the second textile element 132.

Figure 3:
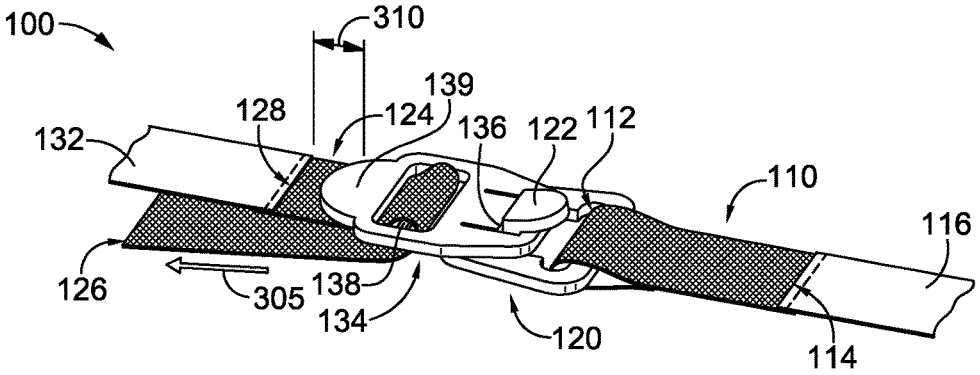
FIG. 3 depicts a side perspective view of the garment adjusting system of FIG. 1 wherein a length of a second strap as measured between a second end of the second strap and a female coupling component is adjusted in accordance with aspects herein.

As shown in FIG. 3, to increase the level of support provided by the second textile element 132 and/or the first textile element 116, the first end 126 of the second strap 124 may be moved in a first direction 305. In example aspects, the first direction 305 is toward the second textile element 132. Because the second strap 124 is slidably coupled to the female coupling component 134, movement of the first end 126 in the first direction 305 causes the distance between the second end 128 of the second strap 124 and the proximal end of the female coupling component 134 to decrease to a second length 310, where the second length 310 is less than the first length 210. This places the second textile element 132 under tension and increases the level of support provided by the second textile element 132. Because the second textile element 132 is indirectly coupled to the first textile element 116 by way of the first and second straps 110 and 124 and the male and female coupling components 120 and 134, movement of the first end 126 of the second strap 124 in the first direction 305 also places the first textile element 116 under tension and increases the level of support provided by the first textile element 116.

Movement of the first end 126 of the second strap 124 in a second direction opposite the first direction 305 would increase the distance between the second end 128 of the second strap 124 and the proximal end of the female coupling component 134 and decrease the level of support provided by the second textile element 132 and/or the first textile element 116. For example, in at least some instance, the tab 139 can be lifted (e.g., by simply inserting one or more fingers beneath the tab 139), which in turn can lift or bias the bar 138 upwards (in the orientation depicted in FIG. 3) and cause the strap 124 to be pulled in a direction opposite 305. In at least some examples, the tab 139 can be referred to as a "release tab" or "support-release tab," based on the operations associated with the tab 139 that can allow for the level of support to be quickly and efficiently (e.g., with one hand) decreased.

Figure 4:
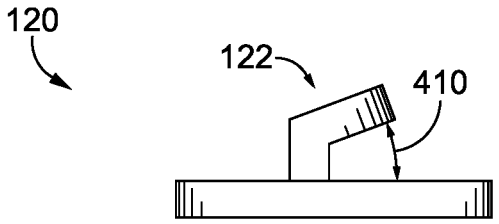
FIG. 4 depicts a side view of a male coupling component of the garment adjusting system described herein in accordance with aspects herein.

FIG. 4 depicts a side view of the male coupling component 120 including the hook 122 that extends at an angle 410 with respect to the surface plane of the male coupling component 120. As described, the angle 410 may be less than about 90 degrees, less than about 80 degrees, less than about 70 degrees, less than about 60 degrees, less than about 50 degrees, less than about 40 degrees, less than about 30 degrees, less than about 20 degrees, or from about 5 degrees to about 40 degrees.

Figure 5:
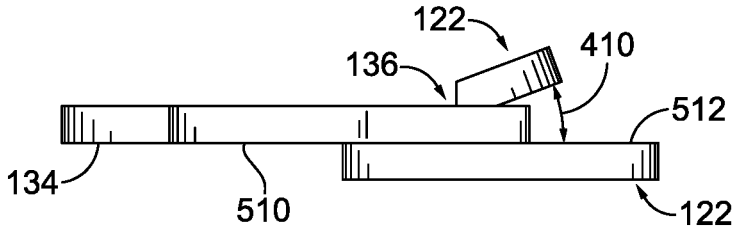
FIG. 5 depicts a side view of a female coupling component of the garment adjusting system described herein releasably mated with the male coupling component of FIG. 4 in accordance with aspects herein.

FIG. 5 depicts a side view of the female coupling component 134 releasably mated with the male coupling component 120. As shown, the hook 122 of the male coupling component 120 extends through the receiving hole 136 of the female coupling component 134. After mating, a surface 510 of the female coupling component 134 is positioned overtop, and is flush with, a surface 512 of the male coupling component 120 to provide a low-profile aesthetic. The angle 410 of the hook 122 helps to prevent the female coupling component 134 from inadvertently disengaging from the male coupling component 120. Stated differently, in example aspects, an affirmative action by the wearer may be needed to disengage the female coupling component 134 from the male coupling component 120.

Figure 7:
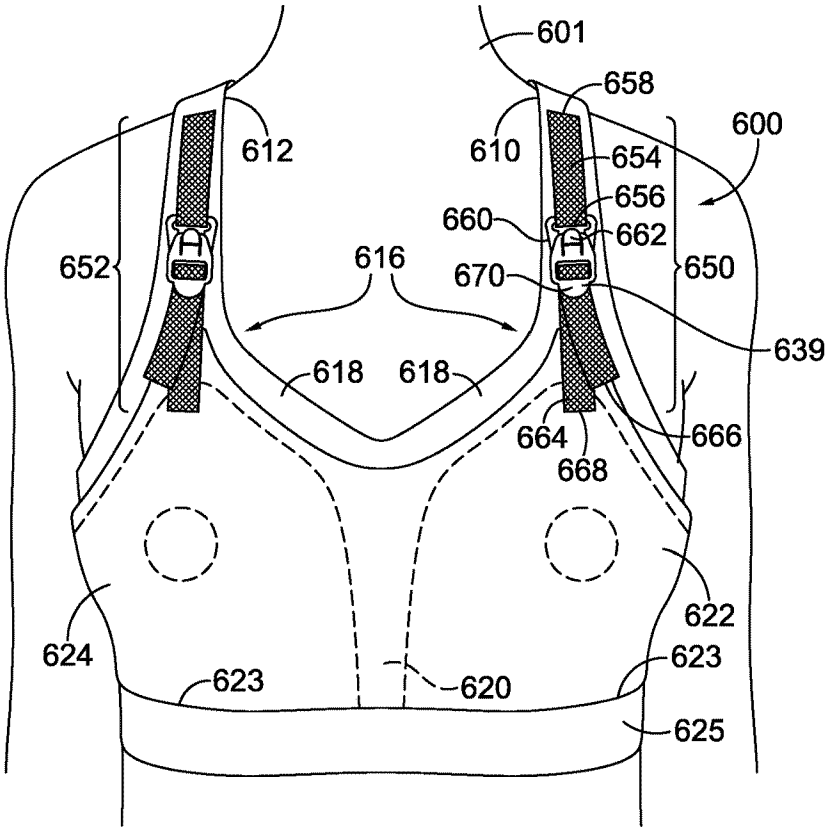
FIG. 7 depicts a front view of the example nursing bra of FIG. 6 wherein the garment adjusting system is in a coupled state in accordance with aspects herein.
Figure 6:
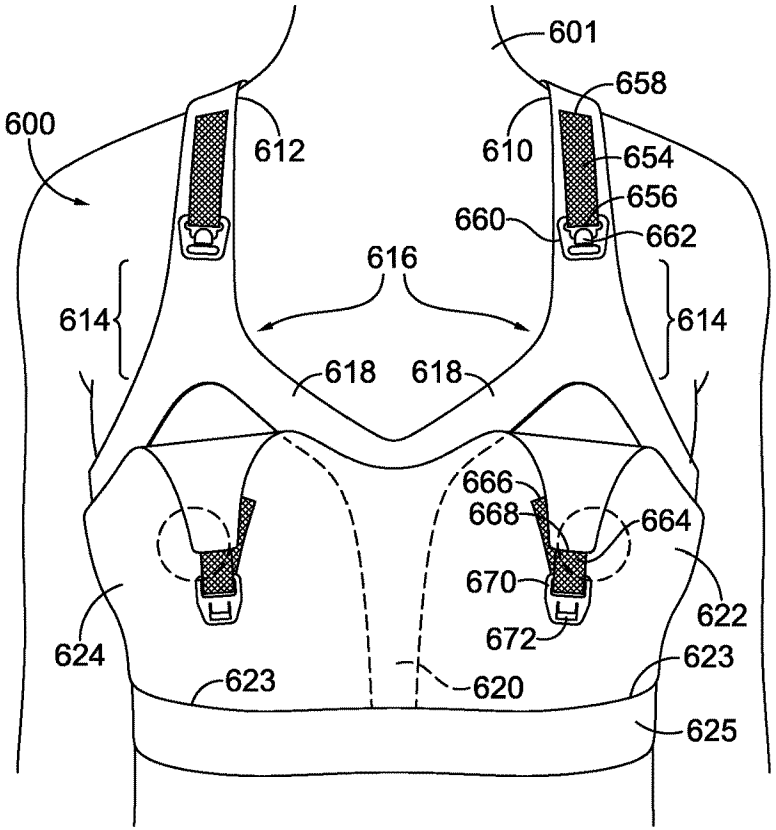
FIG. 6 depicts a front view of an example nursing bra that incorporates the garment adjusting system described herein wherein the garment adjusting system is in an uncoupled state in accordance with aspects herein.

FIGS. 6 and 7 depict a first example use of the garment adjusting system described herein in the form of a support garment and particularly a nursing bra 600 being worn by a wearer 601. FIG. 6 depicts the garment adjusting system in an un-coupled state, and FIG. 7 depicts the garment adjusting system in a coupled state. In general, nursing bras typically include an outer layer that can be raised and lowered as needed to respectively conceal and expose the breast, particularly the nipple area so that the wearer can nurse or pump. With this as a background, the nursing bra 600 includes a first shoulder strap 610 and a second shoulder strap 612 that extend respectively over the shoulders of the wearer 601. The first and second shoulder straps 610 and 612 extend from apex regions 614 of an inner layer 616. The inner layer 616 has an "M-shape" or an inverted "W-shape" with a central leg 620 connected to an upper framework 618. The central leg 620 is configured to extend between the wearer's breasts (i.e., over the wearer's sternum), and the upper framework 618 is configured to be located at the top part of the wearer's breasts. A lower portion of the central leg 620 is shown in dashed line to indicate that the lower portion is positioned internal to one or more additional layers as described below. In example aspects, the lower portion of the central leg 620 may be anchored to an underband 625. The upper framework 618 and the central leg 620 define right and left openings through which the wearer's breasts, and particularly the wearer's nipples extend. The configuration of the inner layer 616 is illustrative only, and it is contemplated herein that other configurations may be used.

The nursing bra 600 further includes a first breast-covering portion 622 and a second breast-covering portion 624 where the first and second breast-covering portions 622 and 624 are positioned external to at least a portion of the inner layer 616. Lower edges 623 of the first and second breast-covering portions 622 and 624 may be affixed to the underband 625 in order to secure or anchor the first and second breast-covering portions 622 and 624 when tension is applied to the first and second breast-covering portions 622 and 624 through use of the garment adjusting system. Alternatively, the lower edges 623 of the first and second breast-covering portions 622 and 624 may form a lower margin of the nursing bra 600 when an underband is not used. With respect to FIG. 6, the upper part of the first and second breast-covering portions 622 and 624 are shown lowered or folded downward to expose or partially expose the wearer's breasts. The first and second breast-covering portions 622 and 624 may be lowered in order to, for example, nurse or pump. In FIG. 7, the first and second breast-covering portions 622 and 624 are raised such that they generally fully cover the wearer's breasts.

A first garment adjusting system 650 is located on the first shoulder strap 610 and the first breast-covering portion 622, and a second garment adjusting system 652 is located on the second shoulder strap 612 and the second breast-covering portion 624 (shown in FIG. 7). A description is provided herein with respect to the first garment adjusting system 650 located on the first shoulder strap 610 and the first breast-covering portion 622. The description is equally applicable to the second garment adjusting system 652 located on the second shoulder strap 612 and the second breast-covering portion 624. The garment adjusting systems described with respect to the nursing bra 600 may be the garment adjusting system 100.

The first garment adjusting system 650 includes a first strap 654 having a first end 656 and an opposite second end 658, where the second end 658 is fixedly secured to the first shoulder strap 610 at or around a location corresponding to where the first shoulder strap 610 curves over the wearer's shoulder. This location is illustrative and other securement locations for the second end 658 are contemplated herein. In this aspect, the first shoulder strap 610 corresponds to the first textile element 116 of the garment adjusting system 100. In example aspects, the first end 656 of the first strap 654 may be maintained adjacent to the first shoulder strap 610 using, for example, a strip of material (not shown) that extends over the first end 656 and has opposing ends that are fixedly coupled to the first shoulder strap 610. This may prevent the first end 656 of the first strap 654 from hanging loose or flapping which may be a distraction to the wearer. A male coupling component 660, which may be the male coupling component 120 is fixedly secured to the first end 656 of the first strap 654. The male coupling component 660 includes a hook 662.

The first garment adjusting system 650 further includes a second strap 664 having a first end 666 and an opposite second end 668, where the second end 668 is fixedly secured to the first breast-covering portion 622 at or near the apex region 614 of the nursing bra 600 with respect to when the first breast-covering portion 622 is fully covering the wearer's breast (e.g., is not folded over). In example aspects, the first breast-covering portion 622 corresponds to the second textile element 132 of the garment adjusting system 100. A female coupling component 670, which may be the female coupling component 134 is slidably coupled to the second strap 664 and includes a receiving hole 672. The first end 666 of the second strap 664 hangs freely.

In FIG. 6, the male coupling component 660 is not releasably mated with the female coupling component 670 such that the first shoulder strap 610 is uncoupled from the first breast-covering portion 622. In this configuration, the first breast-covering portion 622 may be lowered to expose the wearer's breast and nipple area to allow for example, nursing or pumping. In FIG. 7, the male coupling component 660 and the female coupling component 670 are releasably mated by, for example, inserting the hook 662 of the male coupling component 660 into the receiving hole 672 of the female coupling component 670. In this configuration, the first breast-covering portion 622 is coupled to the first shoulder strap 610 such that the first breast-covering portion covers the wearer's breast. To adjust the level of support provided by the first breast-covering portion 622 and/or the first shoulder strap 610, the wearer 601 may grasp the first end 666 of the second strap 664 and pull in a downward direction to decrease the length of the second strap 664 as measured between the second end 668 and the female coupling component 670. This may easily be accomplished using, for example, one hand. An increased level of support may be desirable when the wearer 601 is engaged in, for example, athletic activities. In at least some examples, the level of support can be easily decreased, such as by lifting the tab 639 away from the strap that is threaded through the female coupling component 670.

By utilizing both the first garment adjusting system 650 and the second garment adjusting system 652, the first and second breast-covering portions 622 and 624 can independently be raised and lowered. Additionally, the level of tension of the first and second breast-covering portions 622 and 624 and/or the first and second shoulder straps 610 and 612 can be independently adjusted to account for differences in breast morphology between the two breasts and/or support needs of the wearer 601.

Figure 9:
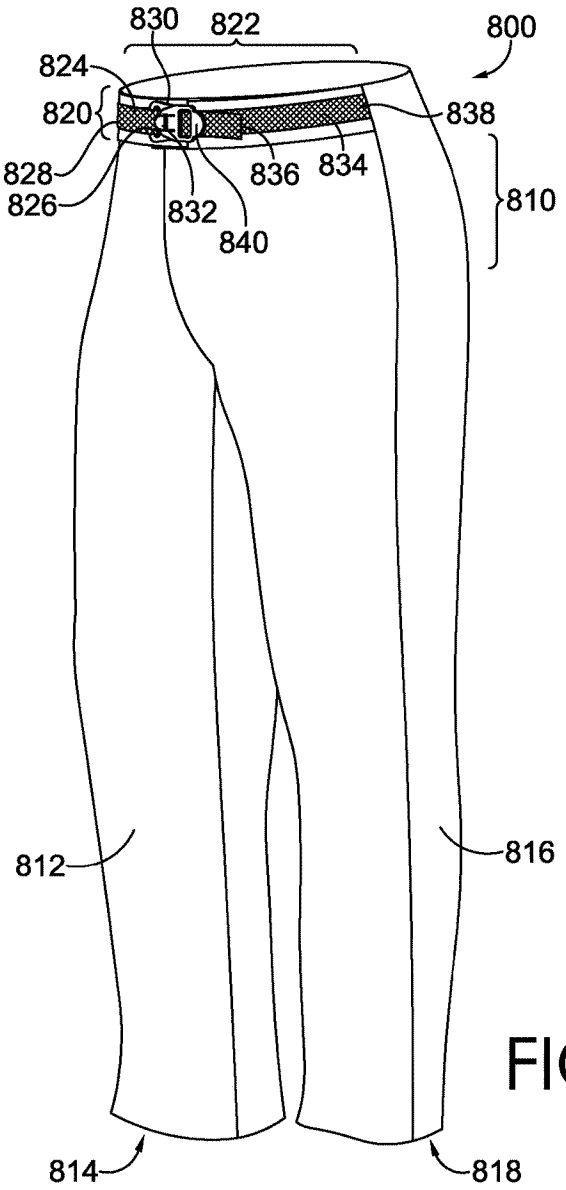
FIGS. 8 and 9 depict an example lower-body garment that utilizes the garment adjusting system described herein in accordance with aspects herein.
Figure 8:
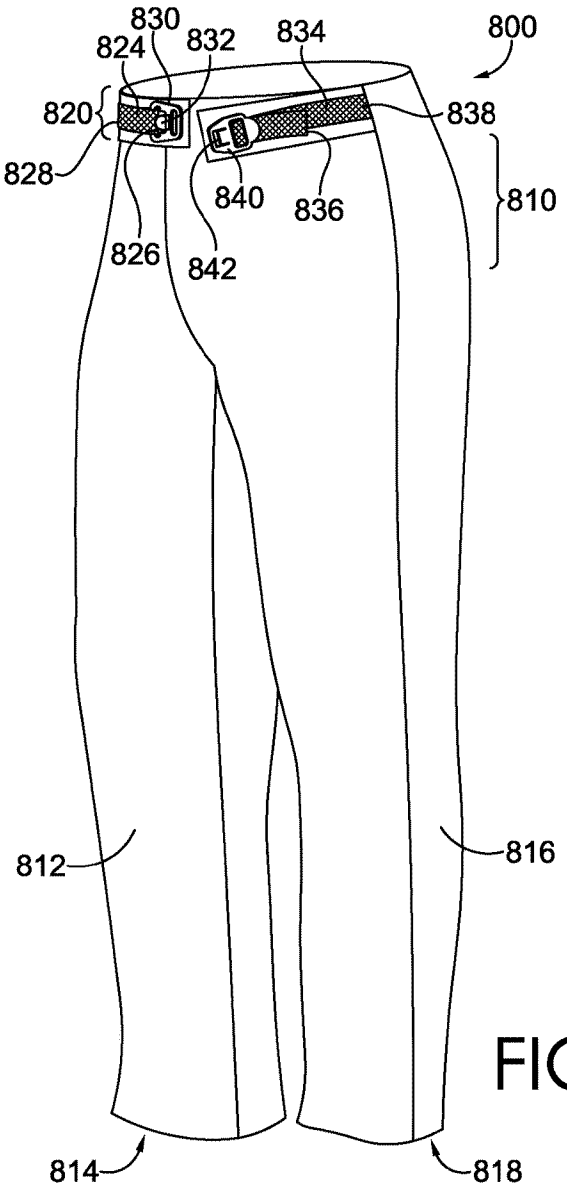

FIGS. 8 and 9 depict the garment adjusting system described herein incorporated into a waistband of a lower-body garment 800. The lower-body garment 800 is shown in the form of a pant, but other configurations such as shorts, leggings, capris, and the like are contemplated herein. The lower-body garment 800 includes a torso portion 810 configured to cover a lower torso of a wearer, a first leg portion 812 terminating in a first leg opening 814, and a second leg portion 816 terminating in a second leg opening 818. The lower-body garment 800 further includes a waistband area 820 configured to encircle a waist area of the wearer. In example aspects, a garment adjusting system 822 (indicated in FIG. 9) may be associated with the waistband area 820. The garment adjusting system 822 includes a first strap 824 having a first end 826 and an opposite second end 828 where the second end 828 is fixedly attached to a first side of the waistband area 820. The first end 826 of the first strap 824 is fixedly attached to a male coupling component 830 having a hook 832.

The garment adjusting system 822 further includes a second strap 834 having a free first end 836 and an opposite second end 838 where the second end 838 is fixedly attached to an opposite second side of the waistband area 820. The second strap 834 is slidably coupled to a female coupling component 840 having a receiving hole 842.

FIG. 8 depicts the garment adjusting system 822 in an un-coupled state where the female coupling component 840 is not releasably mated with the male coupling component 830. This configuration may be useful when a wearer is donning the lower-body garment 800. FIG. 9 depicts the garment adjusting system 822 in a coupled state where the female coupling component 840 is releasably mated with the male coupling component 830 such that the hook 832 is received within the receiving hole 842. The configuration shown in FIG. 9 effectively couples the first side of the waistband area 820 with the opposite second side of the waistband area 820. To tighten the waistband area 820, a wearer may grasp the first end 836 of the second strap 834 and pull to decrease the length of the second strap 834 as measured between the second end 838 of the second strap 834 and the female coupling component 840.

Figure 11:
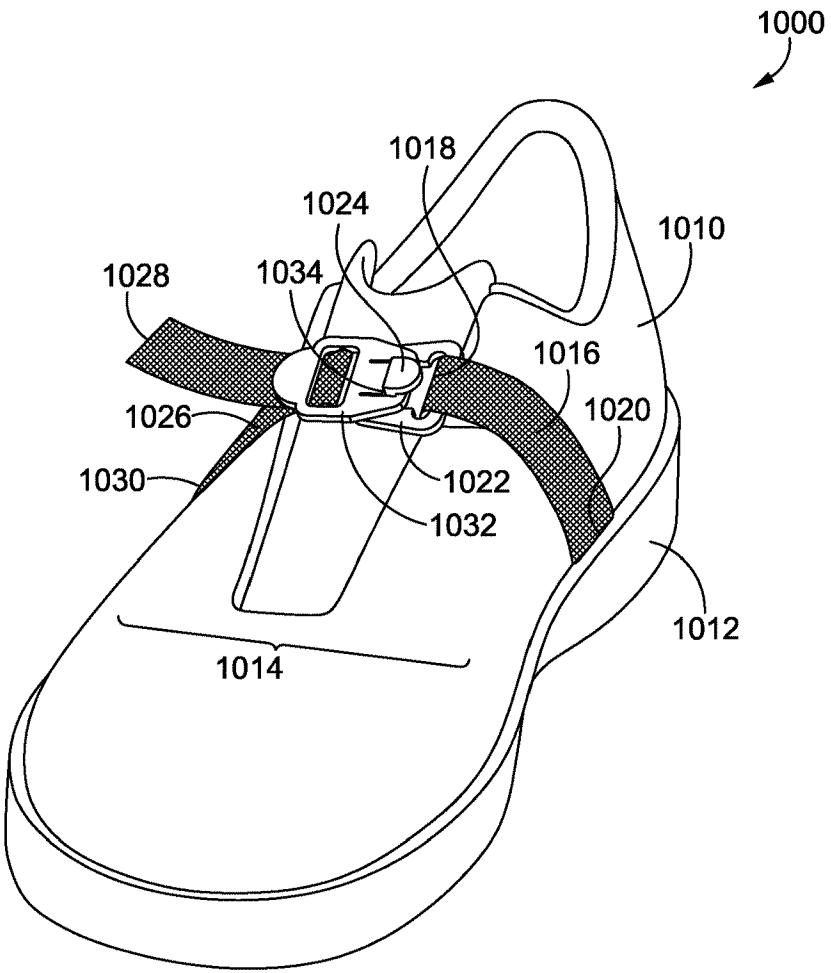
FIGS. 10 and 11 depict an example article of footwear that utilizes the garment adjusting system described herein in accordance with aspects herein.
Figure 10:
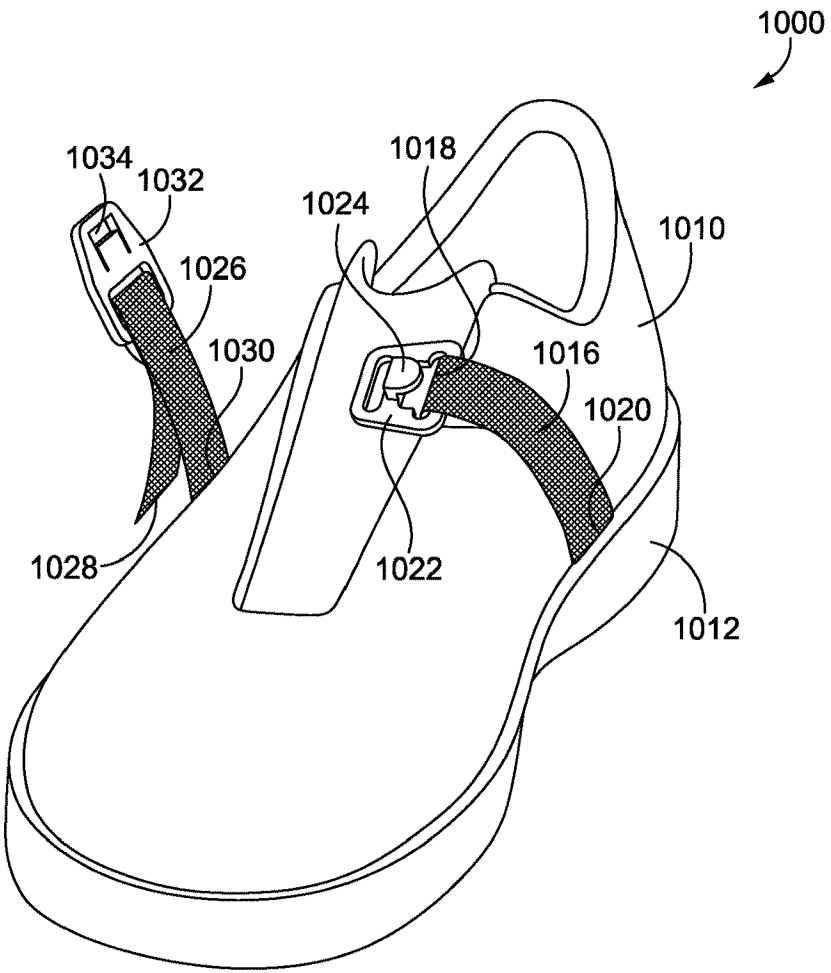

FIGS. 10 and 11 depict yet another example use of the garment adjusting system described herein where the garment adjusting system is incorporated into an article of footwear 1000 in the form of an upper for a shoe. The article of footwear 1000 includes an upper 1010 and a sole structure 1012 secured to a bottom aspect of the upper 1010. The upper 1010 may be formed from a variety of materials including leather, synthetic leather, knit materials, woven materials, braided materials, polymer sheets, rubber, and the like.

In example aspects, the article of footwear 1000 includes a garment adjusting system (indicated by reference numeral 1014 in FIG. 11). The garment adjusting system 1014 extends across an instep area of the upper 1010 when in a coupled state. The garment adjusting system 1014 includes a first strap 1016 having a first end 1018 and an opposite second end 1020 fixedly secured to the article of footwear 1000. A male coupling component 1022 is fixedly secured to the first end 1018 and includes a hook 1024.

The garment adjusting system 1014 further includes a second strap 1026 having a free first end 1028 and an opposite second end 1030 that is fixedly secured to the article of footwear 1000. A female coupling component 1032 is slidably coupled to the second strap 1026 where the female coupling component 1032 includes a receiving hole 1034.

FIG. 10 depicts the garment adjusting system 1014 in an uncoupled state. Having the garment adjusting system 1014 in an uncoupled state may facilitate a wearer inserting their foot into the article of footwear 1000. FIG. 11 depicts the garment adjusting system 1014 in a coupled state where the female coupling component 1032 is releasably mated with the male coupling component 1022 by positioning the hook 1024 within the receiving hole 1034. This action may be accomplished using one hand. To increase the amount of tension across the instep area of the article of footwear 1000, a wearer may grasp the first end 1028 of the second strap 1026 and pull to decrease the length of the second strap 1026 as measured between the second end 1030 and the female coupling component 1032. This step may also be accomplished using one hand. Use of the garment adjusting system 1014 in an article of footwear, such as the article of footwear 1000 may be ideal for people with disabilities and/or for young children.

Figure 12:
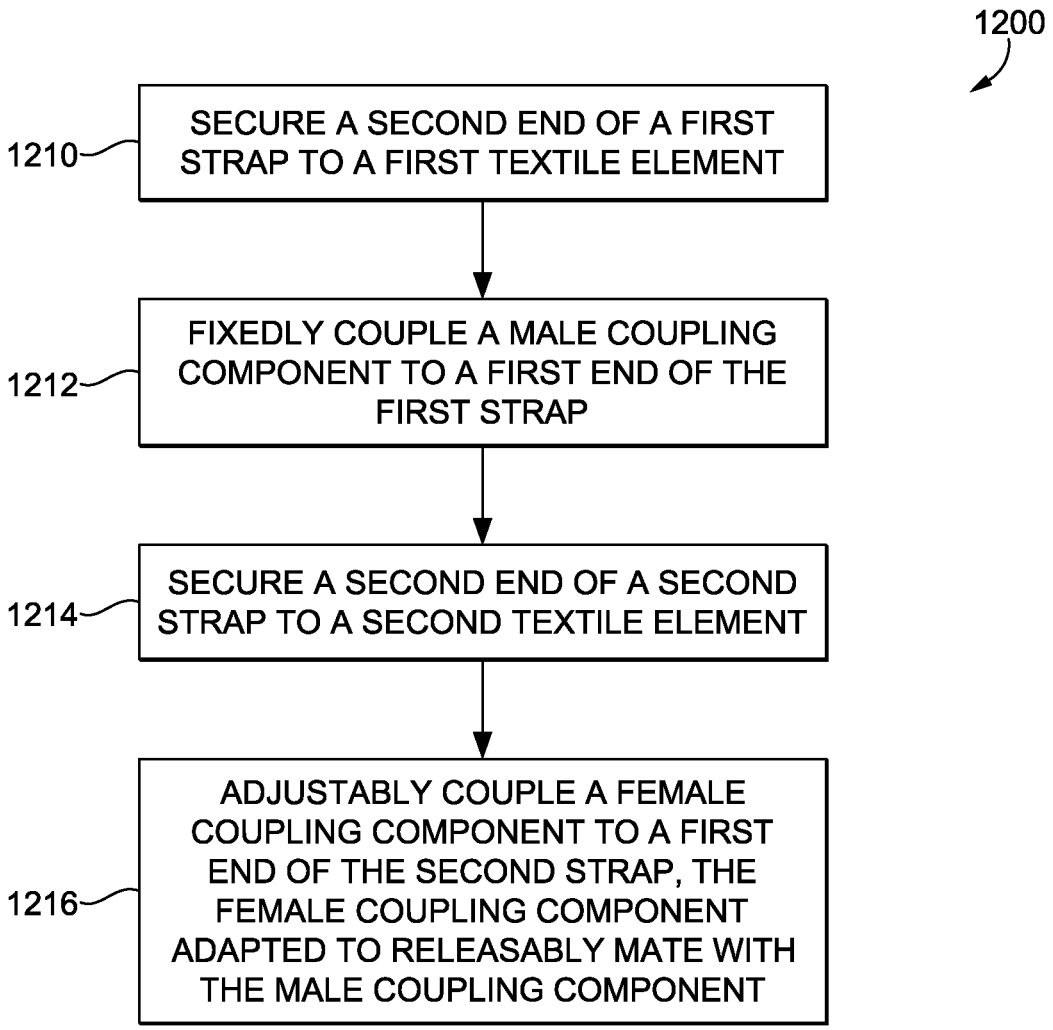
FIG. 12 depicts a flow diagram of an example method of manufacturing a garment adjusting system in accordance with aspects herein.

FIG. 12 depicts a flow diagram of an example method of manufacturing (labeled as 1200) a garment adjusting system such as the garment adjusting system 100. At a step 1210, a second end of a first strap, such as the first strap 110 is secured to a first textile element, such as the first textile element 116. At a step 1212, a male coupling component, such as the male coupling component 120, is fixedly coupled to a first end of the first strap. At a step 1214, a second end of a second strap, such as the second strap 124, is secured to a second textile element, such as the second textile element 132. At a step 1216, a female coupling component, such as the female coupling component 134, is slidably coupled to a first end of the second strap. The female coupling component is adapted to releasably mate with the male coupling component by, for example, positioning a receiving hole of the female coupling component over a hook of the male coupling component. Once coupled, an amount of tension or support provided by the first and second textile elements may be adjusted by manipulating the first end of the second strap to either increase or decrease the length between the second end of the second strap and the female coupling component.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described

What is claimed is:

1. A garment adjusting system comprising:

a first strap having a first end and an opposite second end, the second end of the first strap secured to a first textile element;

a male coupling component fixedly coupled to the first end of the first strap;

a second strap having a first end and an opposite second end, the second end of the second strap secured to a second textile element; and a female coupling component slidably coupled to the second strap, the female coupling component adapted to releasably mate with the male coupling component, wherein the female coupling component is slidable along a length of the second strap such that movement of the female coupling component in a first direction increases a level of support provided by the garment adjusting system and movement of the female coupling component in an opposite second direction decreases the level of support provided by the garment adjusting system, wherein the female coupling component includes a body having a receiving hole at one end, a release tab at an opposing end, and a through hole between the receiving hole and the release tab, and wherein the second strap is slidably threaded through the through hole.

2. The garment adjusting system of claim 1, wherein the first textile element and the second textile element form, at least in part, the garment.

3. The garment adjusting system of claim 1, wherein the first end of the first strap is unaffixed from the first textile element and the second textile element.

4. The garment adjusting system of claim 1, wherein the first end of the second strap is unaffixed from the first textile element and the second textile element.

5. The garment adjusting system of claim 1, wherein the male coupling component includes a hook.

6. The garment adjusting system of claim 1, wherein the garment is a bra.

7. A support garment having an adjusting system, the support garment comprising:

a first strap having a first end and an opposite second end, the second end of the first strap secured to a first shoulder strap;

a male coupling component coupled to the first end of the first strap, wherein the male coupling component includes a hook;

a second strap having a first end and an opposite second end, the second end of the second strap secured to an upper aspect of a breast-covering portion; and a female coupling component adjustably coupled to the second strap, the female coupling component adapted to releasably mate with the male coupling component, wherein when tension is applied to the first end of the second strap, a length of the second strap as measured between the second end of the second strap and the female coupling component is adjusted.

8. The support garment of claim 7, wherein the support garment is a bra.

9. The support garment of claim 8, wherein the first breast-covering portion is an outermost layer of the bra.

10. The support garment of claim 9, wherein the bra further includes an inner layer positioned interior to the first breast-covering portion.

11. The support garment of claim 10, wherein a lower aspect of the first breast-covering portion is secured to a lower margin of the bra.

12. The support garment of claim 7, wherein the female coupling component includes a body having a receiving hole at one end, a release tab at an opposing end, and a through hole between the receiving hole and the release tab, and wherein the second strap is slidably threaded through the through hole.

13. The support garment of claim 7, wherein the first end of the first strap is unaffixed from the first shoulder strap and the first breast-covering portion.

14. The support garment of claim 7, wherein the first end of the second strap is unaffixed from the first shoulder strap and the first breast-covering portion.

15. A bra comprising:

a first strap having a first end and an opposite second end, the second end of the first strap secured to a first textile element;

a male coupling component fixedly coupled to the first end of the first strap;

a second strap having a first end and an opposite second end, the second end of the second strap secured to a second textile element; and a female coupling component slidably coupled to the second strap, the female coupling component adapted to releasably mate with the male coupling component, wherein the female coupling component is slidable along a length of the second strap such that movement of the female coupling component in a first direction increases a level of support provided by the bra and movement of the female coupling component in an opposite second direction decreases the level of support provided by the bra.

16. The bra of claim 15, wherein the female coupling component includes a body having a receiving hole at one end, a release tab at an opposing end, and a through hole between the receiving hole and the release tab, and wherein the second strap is slidably threaded through the through hole.

17. The bra of claim 15, wherein the male coupling component includes a hook.

* * * * *